United States Patent [19]

Earls

[11] 4,273,247

[45] Jun. 16, 1981

[54] BOTTLE CLOSURE-CUP ASSEMBLY

[75] Inventor: William L. Earls, Cincinnati, Ohio

[73] Assignee: Schenley Industries, Inc., New York, N.Y.

[21] Appl. No.: 115,591

[22] Filed: Jan. 28, 1980

[51] Int. Cl.[3] ..... B65D 51/24

[52] U.S. Cl. ..... 215/228; 141/380; 215/295; 215/334; 215/DIG. 7

[58] Field of Search ..... 215/228, DIG. 7, 334, 215/295, 305; 206/217; 220/90.2; 141/21, 22, 379, 380, 381

[56] References Cited

U.S. PATENT DOCUMENTS

| | | | |
|---|---|---|---|
| 2,584,522 | 2/1952 | Wolf | 215/228 X |
| 3,315,830 | 4/1967 | Flynn | 215/334 |
| 4,150,761 | 4/1979 | Collins | 215/228 |

FOREIGN PATENT DOCUMENTS

| | | | |
|---|---|---|---|
| 1414957 | 11/1975 | United Kingdom | 215/295 |

*Primary Examiner*—Donald F. Norton

*Attorney, Agent, or Firm*—Blum, Kaplan, Friedman, Silberman & Beran

[57] ABSTRACT

A bottle closure-cup assembly for use with a bottle having a rotatably removeable cap is provided. The assembly includes a cup having an inner cylindrical collar extending from the cup base and spaced apart from the cup wall. The collar includes a plurality of inwardly facing axial ribs and a plurality of transverse retaining lugs for engaging the cap. Support fins extend between the cup wall and the collar for strengthening the assembly. When the cup is positioned on the cap, the cup and cap may be rotatably displaced as a unit to remove the cap as the cap remains by pulling the cup away from the bottle, thereby allowing the cap to be removed from the bottle separately.

17 Claims, 5 Drawing Figures

BOTTLE CLOSURE-CUP ASSEMBLY

BACKGROUND OF THE INVENTION

This invention relates generally to a bottle closure-cup assembly, and in particular to a bottle closure cup which fits over a rotatably-removable bottle cap and which may be removed independently or in combination with the cap.

Various closure cups for a container and cap assembly employing a cup are known in the art. For example, one such recent development is shown in U.S. Pat. No. 4,150,761 to Herbert Collins issued on Apr. 24, 1979 and assigned to the assignee of the subject application. In this assembly, a cup is provided with a plurality of inwardly projecting ribs which force-fit into engagement with the roughened outer surface of the bottle cap. At least two of the ribs are formed with a projecting seat for securing over the bottle cap and limits the engagement between the ribs and bottle cap.

Other assemblies shown in the art often include closure cups which are secured releasably on the top of a decanter or a vacuum or insulated bottle assembly. One such assembly is shown in U.S. Pat. No. 2,584,522 to S. J. Wolf, wherein a cup fits snuggly about a gasket secured to the neck of a container. In a typical vacuum bottle assembly the cup is secured to the bottle assembly by a separate thread assembly formed about the bottle neck or a locking mechanism which secures the cup about the neck of the container. In these cases, both the cup and the cap cannot be removed in a single operation. The cup is removed independently from the separately secured bottle cap used to close the bottle. When it is desired to open the bottle in these assemblies, the cup must be removed first, and then the bottle cap may be removed. However, it is often desirable to remove both the cup and the bottle cap as a unit in order to reach the contents of the bottle. In addition, the cup must be sized for a particular bottle and neck and is not interchangable with other bottle sizes even if the bottle cap is interchangeable.

The Collins construction has been found to be acceptable for use with certain size bottles wherein it is desirable to remove the cap independently or in combination with the bottle cap. However, it is desirable to provide an improved construction suitable for use with generally larger size bottles. When dealing with larger size bottles the ribs in the Collins type construction tend to deflect. Accordingly, it is desirable to provide an alternative construction which avoids difficulties encountered with the conventional constructions.

SUMMARY OF THE INVENTION

Generally speaking, in accordance with the invention, a bottle closure-cup assembly for a rotatably openable bottle is provided. The assembly includes a cup formed with an internal cylindrical collar spaced apart from the cup walls and a plurality of inwardly facing ribs between the cup wall and the collar. The cylindrical collar includes a plurality of inwardly facing ribs for mating with the knurled outer surface of a rotatably removeable bottle cap.

When the cup is in position secured to the bottle cap, the cup and bottle cap may be rotatably displaced as a unit to remove the bottle cap from the bottle. If desired, the cup can be separated from the bottle cap and bottle while the bottle cap remains on the bottle, by pulling the cup away along axis of the bottle allowing the cap to be removed separately.

Accordingly, it is an object of the invention to provide an improved bottle closure-up assembly.

Another object of the invention is to provide an improved cup for use with a bottle which secures to a bottle cap on the bottle.

A further object of the invention is to provide an improved cup for a bottle closure-cup assembly wherein the cup may be removed independently or in combination with the bottle cap.

Still another object of the invention is to provide an improved bottle closure-cup assembly for use with a bottle receiving a rotatably removeable bottle cap.

Still a further object of the invention is to provide an improved bottle closure-cup assembly wherein the cup has a volume substantially larger than the bottle cap.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
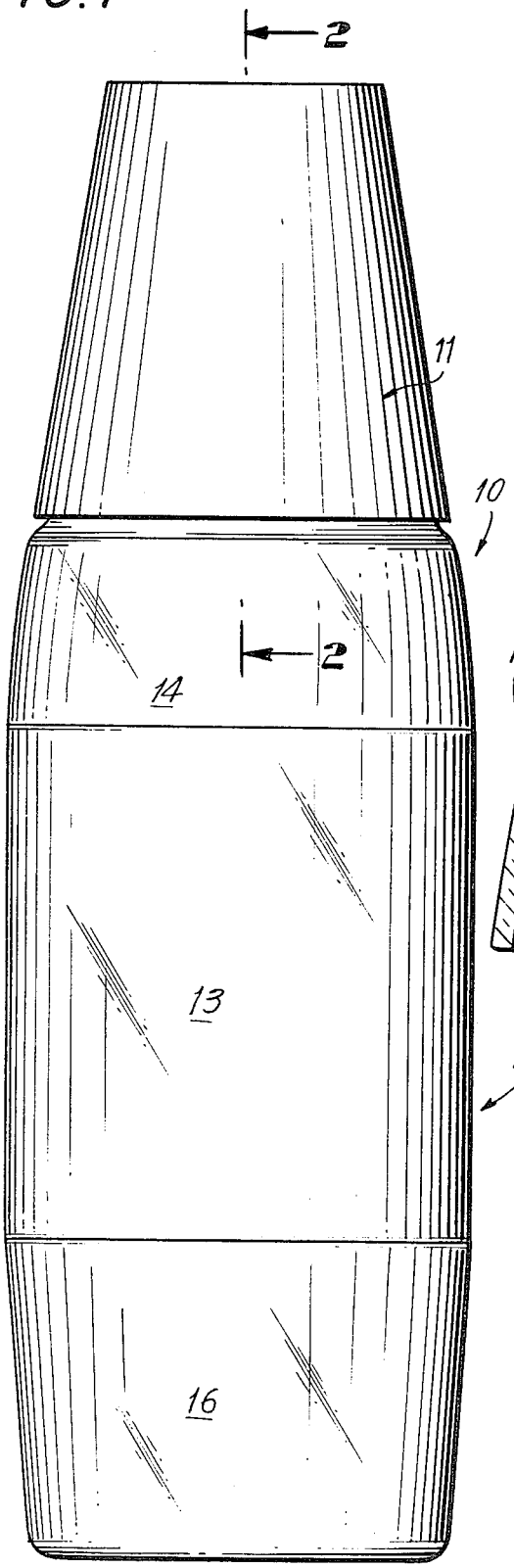
FIG. 1 is a side elevational view of a bottle closure-cup assembly constructed and arranged in accordance with the invention.
Figure 2:
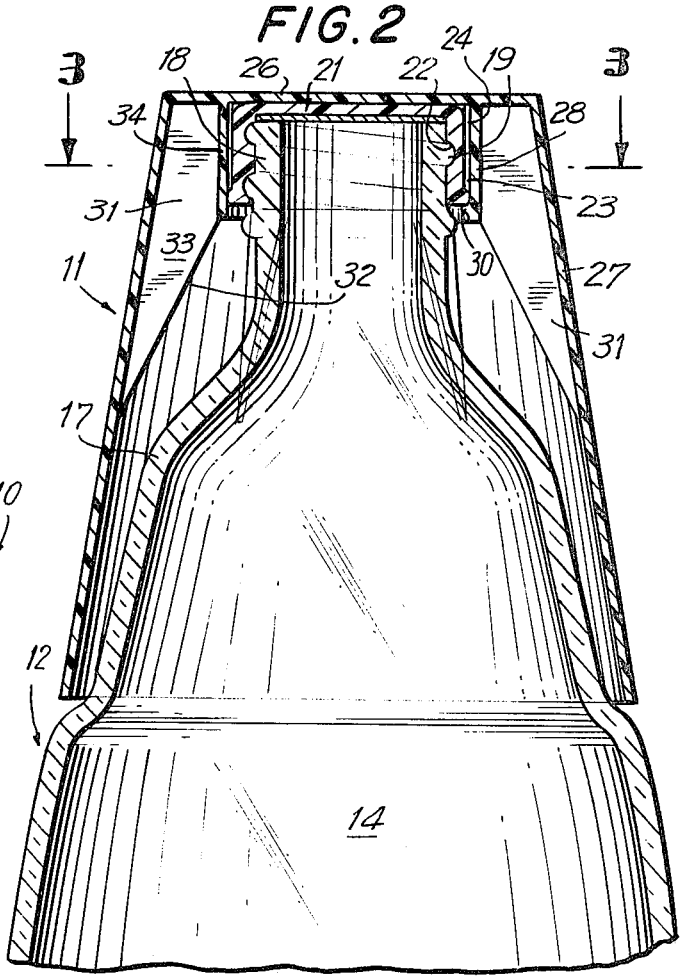
FIG. 2 is a cross-sectional view of the cup and bottle cap on the bottle taken along line 2—2 of FIG. 1.

Referring now to FIGS. 1 and 2, a bottle closure-cup assembly constructed and arranged in accordance with the invention is shown generally as 10. Assembly 10 includes a frusto-conical shoulder portion 14 and a frusto-conical base portion 16. As illustrated in FIG. 2, bottle 12 also includes a frusto-conical neck region 17 terminating in a substantially cylindrical neck 18 having an outer thread 19 thereon.

Bottle 12 is closed and the contents sealed therein by a rotatably-removeable bottle cap 21 which has an internal receiving thread 22 for cooperating with outer thread 19. Bottle cap 21 is formed with an axially ribbed outer surface 23 having a plurality of axial ribs 24 for assisting in engaging with cup 11 as will be described in more detail below. Cup 11 is shown in engagement with cap 21 in FIG. 2.

Figure 3:
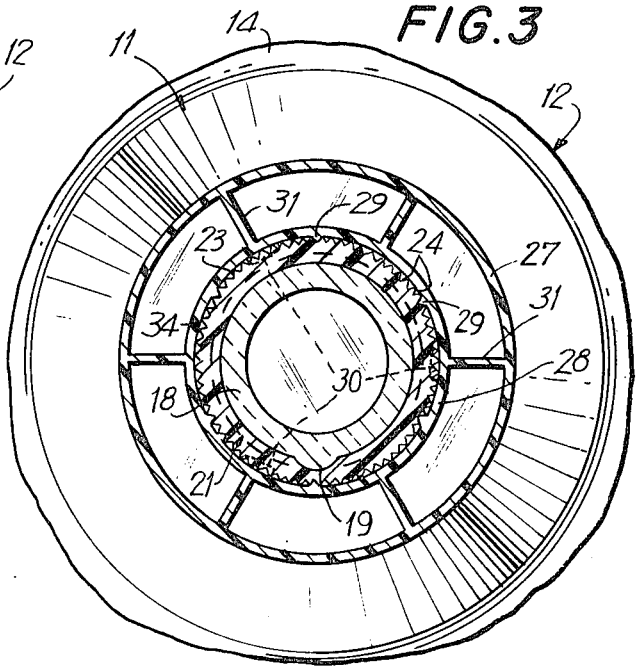
FIG. 3 is a cross-sectional view of the cup and bottle cap on the bottle taken along line 3—3 of FIG. 2.

Referring now to FIGS. 2 and 3, cup 11 has a useable volume substantially greater than bottle cap 21. Cup 11 engages bottle cap 21 and extends over neck region 17 of bottle 12. The shape of cup 21 is shown as frusto-conical and is formed with a flat bottom wall 26 and a frusto-conical side wall 27 extending from bottom wall 26.

For engaging bottle cap 21, cup 11 includes a substantially cylindrical cup collar 28 extending from cup bottom wall 26 and spaced apart from cup side wall 27. Collar 28 is dimensioned to fit snuggly over bottle cap 21 for providing a force-fit engagement between cup 11 and bottle cap 21. In this connection, the internal surface of cap collar 28 includes a plurality of inwardly facing axial projections 29 and transverse retaining lugs 30 for engaging outer surface 23 of cap 21. Axial projections 29 fit tightly between adjacent ribs 24 of cap 21. Transverse lugs 30 are formed near the end of collar 28 and function as a snap ring for engaging the lower edge of cap 21. Thus, collar 28 is formed to extend below the bottom edge of bottle cap 21.

Cup 11 also includes a plurality of inwardly facing fins 31 axially disposed between cup side wall 28 and cup collar 28. In the exemplary embodiment illustrated herein, six equally spaced fins 31 are provided. Each fin 31 extends along cup side wall 27 a distance greater than the height of collar 28, which as noted above extends somewhat below the bottom edge of bottle cap 21. Each fin 31 also includes an axial edge 34 in the region of collar 28 wherein rib 31 is joined to collar 28. The edge of fins 31 beyond collar 28 are smoothly tapered towards side wall 27 for providing a free edge 32 for forming a substantially triangular region 33 in this region beyond collar 28.

In the construction illustrated in the specification, six fins 31 are provided. Fins 31 are spaced equidistantly about the circumference of circular cup bottom wall 18 and extend to a height approximately one-half of cup side wall 27. Similarly, six inwardly facing axial projections 29 are provided on the interior surface of cap collar 28. In the exemplary embodiment, axial projections 29 are provided equidistantly between cup fins 31. Such a construction permits a slight deflection of cup collar 28 in the region between adjacent cup fins 31 for providing the force-fit engagement between cup collar 28 and bottle cap 21. Three equally-spaced transverse retaining lugs 30 are provided on the inner surface of collar 28. In the embodiment shown, retaining lugs 30 are positioned between adjacent axial projections 29 and at the site of cup fins 31. It is to be understood that any number of retaining lugs 30 or axial projections 29 may be provided and their location varied. This force fit engagement between cup 11 and bottle cap 21 is shown in FIGS. 2 and 3.

Figure 4:
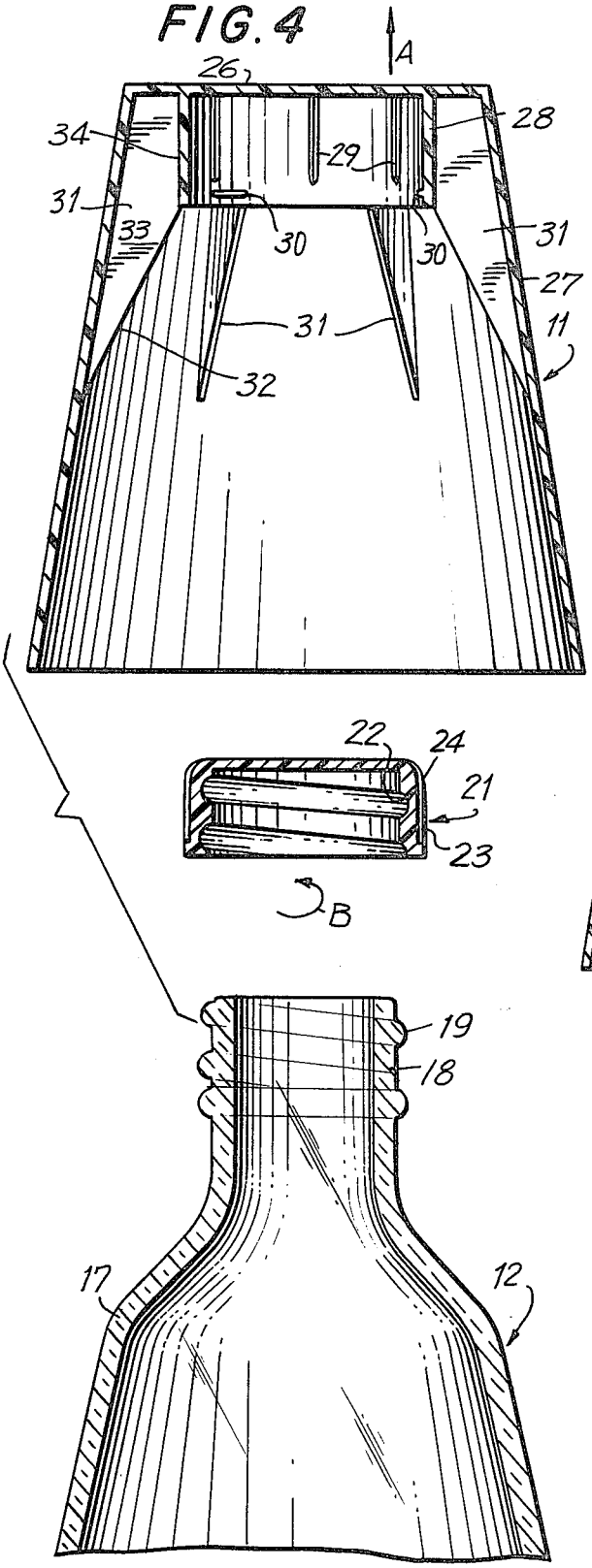
FIG. 4 is an exploded, cross-sectional view showing the cup and bottle cap removed independently from the bottle of FIG. 1.
Figure 5:
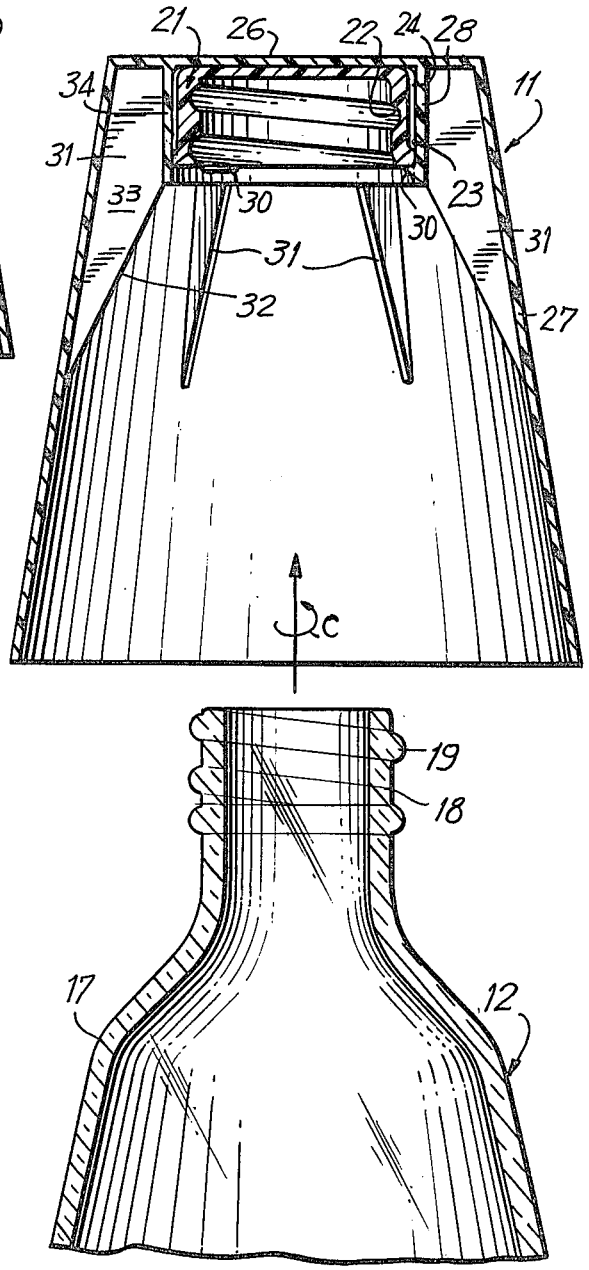
FIG. 5 is an exploded, cross-sectional view illustrating the cup and threaded cap removed from the bottle of FIG. 1 as a unit.

Referring now to FIGS. 4 and 5, it can be seen that the force-fit engagement in accordance with the invention permits cup 11 to be removed from bottle cap 21 by pulling in an axial direction shown by arrow A. Bottle cap 21 then may be removed from bottle 12 by rotatably displacing cap 21 (normally in the counter-clockwise direction) as shown by arrow B. This removal sequence results in an individually useable cup 11, bottle cap 21 and bottle 12 as depicted in FIG. 4. This, cup 11 may be used as a receptacle for the contents of bottle 12. Alternatively, cup 11 and cap 21 may be removed as a unit from bottle 12 as illustrated in FIG. 5. In this configuration the entire assembly with cup 11 engaged to cap 21 may be rotatably removed by twisting in the counter-clockwise direction as shown by arrow C. Cup 11 and bottle cap 21 when in this engaged configuration may be placed onto bottle 12 as a unit by rotating in a clockwise direction.

Bottle 12 may be formed from glass, metal, plastic or any other suitable material. Bottle cap 21 may be metal, plastic or other suitable material. Simiarly, cup 11 may be formed from glass, or preferably a plastic material, such as polyethylene, polypropylene or other substantially rigid polymeric material. Metal or other suitable material which can be formed into the desired shape with cup ribs 21 and collar 28 for fitting into engagement with ribbed outer surface 23 of cap 21 may be used. Outer surface 23 has been shown and described with axial ribs 24 thereon. This surface of bottle cap 21 may be knurled or otherwise roughened for cooperation with inwardly facing axial projections 29 on collar 28. Such a cup may be unitarily molded thereby providing an easily fabricated and inexpensive construction.

Cup 11 is shown with a frusto-conical shape. This shape has been selected for the exemplary embodiment in view of the shape of bottle 12, the desired cup volume and design considerations. Of course, the construction disclosed herein is not intended to be limited to this shape cup and the outer wall of the cup may take practically any configuration desired. The distance between the cup wall and the collar together with the height of the cup side wall controls the volume of the cup.

Accordingly, by constructing and arranging the bottle closure-cup assembly with a plurality of inwardly facing projections and lugs on a cylindrical collar, the cup and bottle cap may be rotatably displaced as a unit to remove the cap from the bottle. Alternatively, the cup can be separated from the bottom merely by pulling up and away from the bottle cap thereby providing a closure cup which may be used for receiving the contents of the bottle.

This construction in accordance with the invention provides a bottle closure-cup assembly particularly well suited for use with larger-sized bottles. In these larger bottles the distance between the cup wall and cap is substantial and merely providing conventional ribs is not satisfactory. Ribs of extended depth would tend to deflect, and thus, not provide the required strength for engagement and removal of the assembly. A construction of heavier or stiffer ribs utilizes substantially more material, is more difficult to mold and is more costly. Accordingly, including a cylindrical collar spaced apart from the cup wall with fins results in a more satisfactory device than the known constructions.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A bottle closure-cup assembly comprising:

a rotatably removeable bottle cap; and a cup having a base and a substantially rigid side-wall extending from said base, a substantially cylindrical collar extending from said base and spaced apart from said side-wall and a plurality of fins extending between said side-wall and said collar, the interior surface of said collar including inwardly projecting means for engaging said bottle cap, whereby said cup and bottle cap may be rotatably displaced as a unit to remove said bottle cap from the bottle and said cup may be separated from the bottle cap by pulling the cup axially away from the bottle without rotating the bottle cap.

2. The bottle closure-cup assembly of claim 1, wherein said projecting means on the interior surface of said collar is a plurality of inwardly facing ribs and said bottle cap is formed with coupling means on the outer peripheral surface thereof for coupling engagement with said ribs on said collar.

3. The bottle closure-cup assembly of claims 1 or 2, wherein said collar extends beyond the height of said bottle cap and the interior surface of said collar includes at least one transverse retaining lug for engaging the bottom edge of said bottle cap.

4. The bottle closure-cup assembly of claim 1, wherein said fins between said cup side-wall and collar extend from the base a distance greater than the height of said collar.

5. The bottle closure-cup assembly of claim 4, wherein the region of said fins extending beyond said collar are tapered to said cup side wall and extend to a height of about one-half the height of said side-wall.

6. The bottle closure-cup assembly of claim 5, wherein said cup is frusto-conical in shape.

7. The bottle closure-cup assembly of claim 2, wherein said coupling means on the surface of said cap includes a plurality of spaced axial ribs projecting from the surface of said cap extending substantially parallel to said ribs on the interior surface of said collar, said cap ribs defining grooves therebetween for receipt of said inwardly facing ribs on the collar.

8. The bottle closure-cup assembly of claims 1 or 7 wherein said cup is formed with six equally-spaced fins disposed between said wall and said collar.

9. The bottle closure-cup assembly of claim 8, wherein the interior surface of said collar is formed with six inwardly facing equally-spaced axial ribs for engaging said bottle cap.

10. The bottle closure-cup assembly of claim 9, wherein said six ribs on the interior surface of the collar are disposed equidistantly between said fins.

11. The bottle closure-cup assembly of claim 10, wherein the interior surface of said collar further includes three equally-spaced transverse retaining lugs for engaging the bottom edge of said bottle cap.

12. The bottle closure-cup assembly of claim 1, wherein said bottle cap includes an internal thread for coupling to a threaded bottle.

13. A bottle closure-cup assembly comprising:

a rotatably removeable bottle cap; and a cup having a base and a substantially rigid side-wall extending from said base, a substantially cylindrical collar extending from said base and spaced apart from side-wall and a plurality of cup fins extending between said side-wall and said collar from said base a distance greater than the height of said collar, the interior surface of said collar including a plurality of inwardly facing ribs for engaging the bottle cap, said bottle cap formed with outwardly projecting ribs on the outer perpherial surface for coupling with said collar, whereby said cup and bottle cap may be rotatably displaced as a unit to remove said bottle cap from the bottle and said cup may be separated from the bottle cap independently by pulling the cup axially away from the bottle without rotating the bottle cap.

14. The bottle closure-cup assembly of claim 13, wherein the interior surface of said collar includes six equally-spaced axial ribs for engaging the projecting ribs on said cap and three transverse lugs for engaging the bottom edge of said cup.

15. The bottle closure-cup assembly of claim 14, wherein said cup is formed with six equally-spaced fins.

16. The bottle closure-cup assembly of claim 14, wherein the ribs on the interior surface of said collar are disposed mid-way between the fins.

17. The bottle closure-cup assembly of claim 14, wherein said cup is frusto-conical in shape.

* * * * *